US007458792B2

(12) United States Patent
Grahle et al.

(10) Patent No.: US 7,458,792 B2
(45) Date of Patent: Dec. 2, 2008

(54) SINTERED METAL ROTOR OF A ROTARY PISTON PUMP

(75) Inventors: Peter Grahle, Feldbrunnen (CH); Peter Haldemann, Grenchen (CH); Walter Nünlist, Olten (CH); Heinz Rhyn, Grossaffoltern (CH); Albert Friesen, Mönchengladbach (DE); Stanislaus Russ, Mönchengladbach (DE)

(73) Assignees: Mahle Motorkomponenten Schweiz AG, Grenchen (CH); Pierburg GmbH, Neuss (DE)

( * ) Notice: Subject to any disclaimer, the term of this patent is extended or adjusted under 35 U.S.C. 154(b) by 310 days.

(21) Appl. No.: 10/541,016

(22) PCT Filed: Jun. 16, 2004

(86) PCT No.: PCT/DE2004/001239

§ 371 (c)(1),
(2), (4) Date: Jun. 28, 2005

(87) PCT Pub. No.: WO2005/001293

PCT Pub. Date: Jan. 6, 2005

(65) Prior Publication Data

US 2006/0165545 A1 Jul. 27, 2006

(30) Foreign Application Priority Data

Jun. 30, 2003 (DE) ..... 103 29 495

(51) Int. Cl.
*F01C 21/00* (2006.01)
*F03C 2/00* (2006.01)

(52) U.S. Cl. ..... 418/179

(58) Field of Classification Search ..... None
See application file for complete search history.

(56) References Cited

U.S. PATENT DOCUMENTS

| | | | | | |
|---|---|---|---|---|---|
| 3,622,254 | A | * | 11/1971 | LeBlanc, Jr. | 418/226 |
| 3,726,572 | A | * | 4/1973 | Beardmore | 384/113 |
| 4,248,813 | A | * | 2/1981 | Hattori et al. | 264/645 |
| 5,252,048 | A | * | 10/1993 | Fujiwara et al. | 418/220 |
| 5,548,973 | A | * | 8/1996 | Komine et al. | 62/469 |

(Continued)

FOREIGN PATENT DOCUMENTS

DE 40 18 509 1/1991

(Continued)

*Primary Examiner*—Thomas Denion
*Assistant Examiner*—Douglas J. Duff
(74) *Attorney, Agent, or Firm*—Collard & Roe, P.C.

(57) ABSTRACT

The invention relates to a sintered metal rotor of a rotary piston pump, comprising a pot-shaped base (1) and a journal element centrally projecting from the bottom of said base (1). Said journal element comprises a base section and an adjoining connecting claw section (2) for a coupling element to be joined thereto. The rotor is characterized in that the connecting claw section (2) is configured in the form of two prominent single webs (3). Said single webs (3) are located at a diametrical distance to each other in the periphery of the cylindrical base section in one area each that is limited, in terms of its periphery, to not more than 100°. and radially to not more than 25% of the diameter of the cylindrical base section. The two connecting claw single webs (3) are pressure-sintered by means of single pressure rams that are designed for the cross-sectional areas thereof and that are actuated separately from the sinter pressure rams required to produce the rotor.

13 Claims, 2 Drawing Sheets

U.S. PATENT DOCUMENTS

Figure 1:
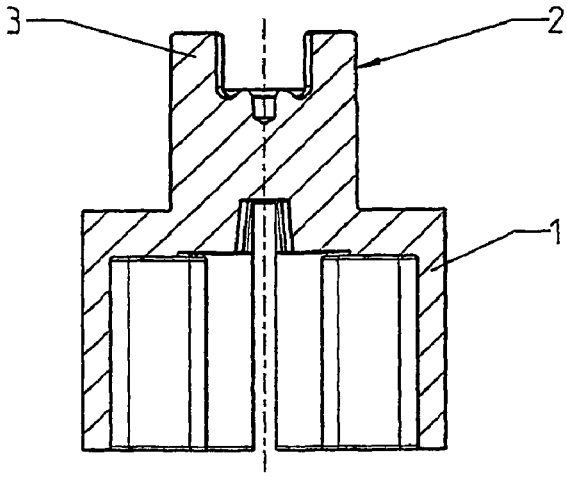

| | | | | |
|---|---|---|---|---|
| 5,879,138 | A * | 3/1999 | Arndt et al. | 417/244 |
| 5,976,214 | A * | 11/1999 | Kondoh et al. | 75/244 |
| 6,648,619 | B2 * | 11/2003 | Otto | 418/152 |
| 6,743,004 | B2 * | 6/2004 | Otto | 418/152 |
| 6,923,628 | B1 * | 8/2005 | Otto | 418/152 |
| 2002/0150489 | A1 * | 10/2002 | Kim | 418/13 |
| 2003/0185696 | A1 * | 10/2003 | Otto | 418/152 |

FOREIGN PATENT DOCUMENTS

| | | | |
|---|---|---|---|
| DE | 40 20 082 | | 1/1991 |
| DE | 4020082 | A1 * | 1/1991 |
| DE | 197 03 499 | | 8/1998 |
| DE | 19703499 | A1 * | 8/1998 |
| EP | 0 822 876 | | 2/1998 |
| EP | 1 108 892 | | 6/2001 |
| JP | 01142287 | A * | 6/1989 |
| JP | 06 249172 | | 9/1994 |

* cited by examiner

SINTERED METAL ROTOR OF A ROTARY PISTON PUMP

CROSS REFERENCE TO RELATED APPLICATIONS

Applicants claim priority under 35 U.S.C. §119 of German Application No. 103 29 495.3 filed Jun. 30, 2003. Applicants also claim priority under 35 U.S.C. §365 of PCT/DE2004/001239 filed Jun. 16, 2004. The international application under PCT article 21(2) not published in English.

This invention relates to a sintered metal rotor of a rotary piston pump according to the preamble of Patent Claim 1 and a method for manufacturing this rotor.

Such a rotor is known from DE 197 03 499 A1, for example. The rotor there is manufactured in three parts, namely a sintered pot part, a rotary steel part and a copper ring, in a very time-consuming and cost-intensive process. The rotary part is soldered to the sintered pot part over the copper ring after prior carburization. During the heat treatment which is necessary for soldering, the copper of the copper ring diffuses into pore zones of the sintered component that are at risk of fracture and thereby ensures that the rotor will have adequate fracture stability in the area of the rotary part. The steel rotary part forms the connecting claw section of the rotor. The claw in this area, to which a coupling is attached, is designed to run over the entire diameter of the soldered steel rotary part. For example, the known rotor could be manufactured by a sintering process known from EP 0 822 876 B1. The reason for the joining of multiple parts, i.e., at least two prefabricated starting parts, as described above, is that the coupling area in the case of a one-piece sintered rotor could not previously be produced with adequate strength for continuous operation of the rotor.

This invention is concerned on the whole with the problem of especially economical and inexpensive manufacturing of a generic sintered metal rotor having adequate long-term strength in its coupling area in particular.

This problem is solved by a design of a generic rotor according to the characterizing features of Patent Claim 1. Advantageous and expedient embodiments are the object of the subclaims.

An advantageous embodiment of a coupling element to be attached is derived from the inventive shape of the connecting claw section of the rotor.

Furthermore, the last subclaim describes a manufacturing process with a sintering compression mold which has a particularly advantageous design for this implementation.

This invention is based on the general ideal of imparting a shape to the rotor, especially in the connecting claw section, that allows manufacture of the rotor using a compression mold with a number of mold rams that can be acted upon individually with a sintering pressure sufficient for all the function areas. Due to the division of the connecting claw section into two separate, diametrically opposed individual webs, it is possible to adequately compress these individual webs due to this sintered compression mold ram that can be acted upon separately to an adequate extent for the material stability required in this area. This is possible because the compression pressure is to be applied only to a small cross-sectional area in each case, so that an extremely high specific pressure can be achieved in these cross-sectional areas.

As known in general and in particular also with a generic rotor from DE 197 03 499 A1, the strength of sintered steels can be increased by filling the pores with a low-melting metal (impregnation alloys), e.g., copper or copper alloys. Therefore, in the case of the inventive rotor, at least the individual webs are infiltrated with copper accordingly with transitional areas to the adjacent rotor body. To this end, before exposing the sinter-pressed base material to the required sintering temperature, the surfaces of the areas that are to be infiltrated with copper are provided with a layer of copper. Under the heat of sintering, the copper applied in this way melts and penetrates into the material beneath the coated surfaces due to capillary action in particular. Through an appropriate choice of the thickness of the copper layers to be applied, complete penetration of at least the individual webs including adjacent transitional areas can be achieved. Therefore, in the case of a rotor made of sintered steel, it is possible to achieve a density of up to 8 g/cm$^3$ or more, at least in the individual webs. It is essentially possible to practically eliminate the pore volume of the sintered and pressed molding, so that because of the higher specific gravity of copper in comparison with steel the specific gravity of a sintered steel body infiltrated with copper in this way can be higher than the specific gravity of steel. Therefore, the individual webs including the transitional areas of the rotor adjacent to them, have extremely good strength properties.

An advantageous exemplary embodiment of this invention is explained in greater detail below on the basis of the drawing.

Figure 2:
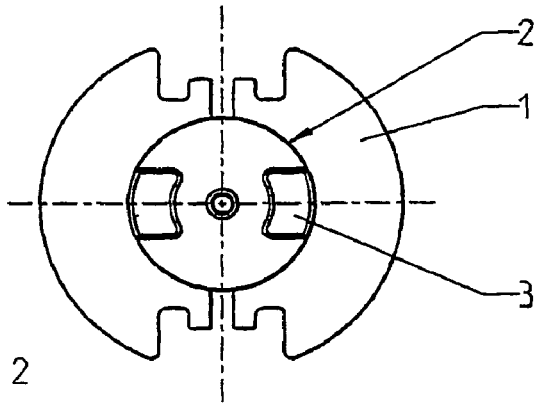
Figure 3:
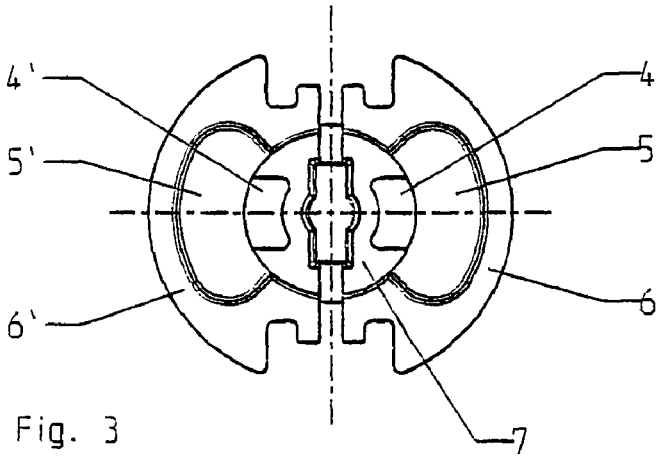
Figure 4:
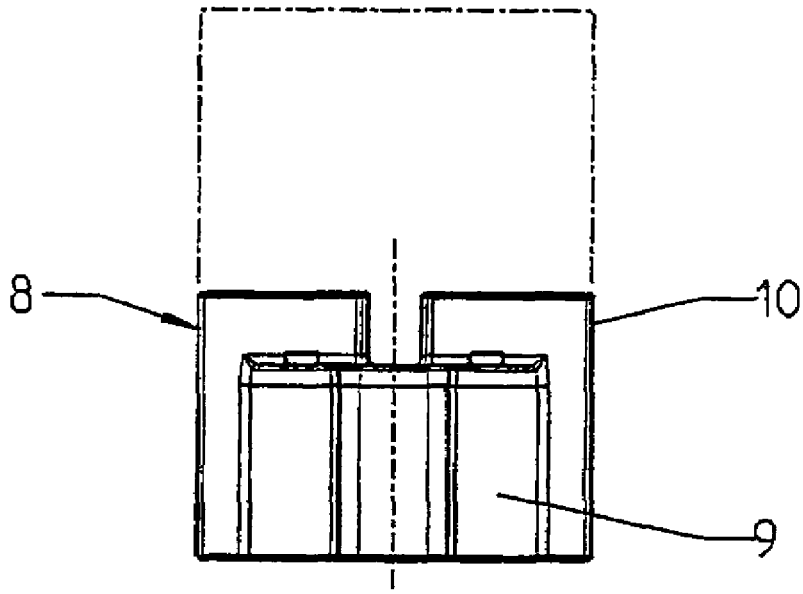
Figure 5:
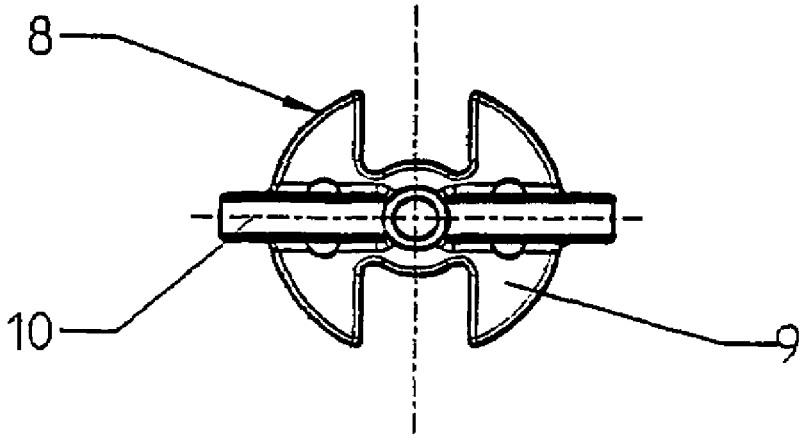

The drawing shows:

FIG. 1 a cross section through a sintered rotor,

FIG. 2 a top view of the rotor according to FIG. 1,

FIG. 3 a view of the rotor according to FIG. 1 from beneath,

FIG. 4 a front view of a coupling element that can be attached to the rotor, FIG. 5 a top view of the coupling element according to FIG. 4.

The rotor consists of a pot-shaped base body 1 and a cylindrical foot area protruding away from its bottom with a connecting claw section 2 connected thereto. Two diametrically opposed individual webs 3 of the same size and shape protrude axially outward as connecting claws in the connecting claw section 2. These individual webs 3 extend over an area of approximately 90° in the circumferential direction and diametrically they assume approximately 20% of the diameter of the connecting claw section. These values are given only as expedient examples and should not constitute fixed range limits to this extent. Instead these limits are defined in the patent claims.

The individual webs 3 are case-hardened in profiles, whereby this hardening may be inductively produced. The case-hardened area of the individual webs 2 may be cooled, in particular shock-cooled, to permit the required material strength to be achieved with a high certainty.

The particular feature of the invention consists of the shaping of the connecting claw section 2 through the individual webs 3 designed as indicated here and the possibility thus provided of being able to compact the material of these individual webs 3 to a sufficient extent in sintered production of the rotor. This high compaction is achieved by a sintering compression mold equipped with sintering compression rams that can be operated separately and are assigned to the individual webs by cross section. The inside areas of the rotor 1 which are assigned to these separately operable sintering mold rams are labeled with reference notation 4, 4' in FIG. 3.

The sintering mold having these two separate rams 4, 4' consists of a total of seven rams which can be acted upon individually with pressure. Two of these rams are the rams 4, 4' already mentioned above. The other rams are assigned to rotor areas that are labeled as 5, 5'; 6, 6' and 7 in FIG. 3.

The rotor is made of the following materials: 0.6% to 0.8% carbon, 0.1% to 0.3% manganese, max. 1% other, the remainder iron, and is sintered in one piece. The specific sintering pressure is sufficient to achieve a material density of 6.8 to 7.4 g/cm$^3$, preferably in all areas of the rotor but definitely in the area of the individual webs 3 of the connecting claw section.

If, in the production of the sintered rotor in the sintering heating process, copper from a copper layer applied to at least the areas of the individual webs is incorporated into the interior of the material, i.e., into the pores of the sintered material at these locations through capillary action, then with respect to the sintered steel material indicated above, the use of a copper material having the following composition, for example, is recommended: 3% to 5% iron, 0.6% to 1.5% manganese, max. 2% other, remainder copper.

The copper layers may be applied in cap form to the individual webs that have already been sinter-pressed before they are subjected to the hot sintering process. This means that suitably shaped caps, hats or pot-shaped structures are easily placed on the respective areas of material to be infiltrated with copper before performing the hot sintering process. The thickness of the copper layers, i.e., the wall thickness of the caps to be placed on the material can easily be determined experimentally, e.g., by ensuring complete penetration of the material areas to be treated accordingly. Essentially the required amount of copper to be used may of course also be determined correctly by calculation, at least approximately.

A coupling element 8 adapted to the connecting shape of this section may be placed on the connecting claw section 2. This coupling element 8 includes a connecting claw section 9 which is integrated into a longitudinal web 10 as a connecting element for a component to be connected. Due to this design of the coupling element 8, couplings of different lengths can be manufactured and used easily.

All the features depicted in the description and in the following claims may be essential to the invention either individually or together in any form.

The invention claimed is:

1. A method for producing a sintered metal rotor of a rotary piston pump, in particular a rotary piston pump for generating a vacuum of a vacuum brake booster of a motor vehicle, where the brake booster can be connected to a vacuum pump intake connection, with a pot-shaped base body (1) and a bearing journal element which protrudes centrally from the bottom of this base body (1) from a cylindrical foot area coming directly out of the bottom and a connecting claw section (2) to be connected to it for a coupling element to be attached, comprising the features the connecting claw section (2) is designed in the form of two protruding individual webs (3), the individual webs (3) are diametrically opposed in the outside circumferential area of the cylindrical base section in an area limited to max. 100° at the circumference and radially to max. 25% of the diameter of the cylindrical base section, and assigning separate rams to the individual webs (3) according to cross section of the web and providing each ram with a separate pressure acting on them in a sintering compression mold for producing the sintered rotor; and wherein the produced rotor has the structure of a one piece, press-sintered rotor with differently compressed regions, whereby the individual webs (3) are compressed to a sufficient degree for the material stability required in each region, and the sintering pressure is sufficient to achieve a material density of 6.8 to 7.4 g/cm$^3$.

2. The method according to claim 1, wherein the two individual webs (3) have the same size and shape.

3. The method according to claim 1, wherein the circumferential area assumed by an individual web (3) is limited to max. 90°.

4. The method according to claim 1, wherein the area assumed radially by the individual webs (3) is limited to max. 20% of the cylindrical base section.

5. The method according to claim 1, wherein the individual webs (3) of the connecting claw section are case-hardened in edge profiles.

6. The method according to claim 1, wherein the case-hardening in edge profiles is inductively generated.

7. The method according to claim 1, wherein the edge-hardened area is shock cooled.

8. The method according to claim 1, wherein the individual webs (3), including at least one transitional area directly adjacent in the direction of the rotor base body, contain copper that has been infiltrated subsequently into the pressed sintered structure.

9. The method according to claim 8, wherein a single web (3) enriched with copper has a specific gravity of at least 7.5 g/cm$^3$.

10. The method according to claim 9, wherein the specific gravity is greater than 7.8 g/cm$^3$.

11. The method according to claim 10, wherein the specific gravity is at least 7.9 to 8.0 g/cm$^3$.

12. The method according to claim 1, having a sintered coupling element, p1 wherein the coupling element has a cross section that has been adapted to the development of the connecting claw section (2) with a rod-shaped torque abrasion area in the form of an elongated web (10).

13. The method for manufacturing a rotor according to claim 1, wherein copper that is present in infiltrated form at least in the individual webs (3) penetrates out of a superficially copper layer applied at least to the individual webs (3) and into the sintered structure during the sintering heat treatment.

* * * * *